US008926800B2

(12) United States Patent
Krebber et al.

(10) Patent No.: US 8,926,800 B2
(45) Date of Patent: Jan. 6, 2015

(54) DEVICE FOR COMPENSATING DEVIATIONS FROM A COAXIAL ARRANGEMENT OF COMPONENTS OF A REGULATING ORGAN TO CONTROL THE GAS PRESSURE OF A COKE OVEN CHAMBER

(75) Inventors: Frank Krebber, Essen (DE); Kerstin Ueberschaer, Gladbeck (DE); Helmut Dobert, Hattingen (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 380 days.

(21) Appl. No.: 13/261,024

(22) PCT Filed: Apr. 27, 2010

(86) PCT No.: PCT/EP2010/002578

§ 371 (c)(1),
(2), (4) Date: Jan. 26, 2012

(87) PCT Pub. No.: WO2010/136101

PCT Pub. Date: Dec. 2, 2010

(65) Prior Publication Data

US 2012/0118721 A1 May 17, 2012

(30) Foreign Application Priority Data

May 29, 2009 (DE) ..... 10 2009 023 222

(51) Int. Cl.
*C10B 27/06* (2006.01)
*C10B 41/08* (2006.01)

(52) U.S. Cl.
CPC ..... *C10B 27/06* (2013.01); *C10B 41/08* (2013.01)
USPC ..... 202/255; 202/256; 202/269

(58) Field of Classification Search
CPC ..... C10B 27/06; C10B 41/08
USPC ..... 202/255, 256, 269
See application file for complete search history.

(56) References Cited

U.S. PATENT DOCUMENTS

| | | | | |
|---|---|---|---|---|
| 1,540,513 | A * | 6/1925 | Cavett | 137/181 |
| 2,082,118 | A * | 6/1937 | Potter | 202/258 |
| 2,211,156 | A * | 8/1940 | Otto | 202/255 |

(Continued)

FOREIGN PATENT DOCUMENTS

| | | |
|---|---|---|
| CA | 2 194 489 A1 | 2/1996 |
| DE | 525 974 C | 6/1931 |

(Continued)

*Primary Examiner* — Prem C Singh
*Assistant Examiner* — Jonathan Miller
(74) *Attorney, Agent, or Firm* — Marshall & Melborn, LLC

(57) ABSTRACT

A device for compensating deviations from a coaxial arrangement of components of a regulating organ, said regulating arrangement being comprised of a regulating organ, a crown pipe, and an immersion cup which serve for controlling the gas pressure of a coke oven chamber, with the regulating arrangement being comprised of an immersion cup with a water immersion that seals the gas space of a coke oven chamber versus the gas collecting main and/or plant units downstream, and wherein the height of the water level of the water immersion represents a regulating means to control the gas pressure, and wherein said regulating arrangement is furthermore comprised of an immersion pipe that configures a specially shaped crown pipe at its end submerging into the water of the immersion cup, and that is comprised of a regulating organ to regulate the water level.

14 Claims, 5 Drawing Sheets

(56) References Cited

U.S. PATENT DOCUMENTS

| | | | | |
|---|---|---|---|---|
| 4,168,208 | A * | 9/1979 | Althoff et al. | 202/254 |
| 4,197,164 | A * | 4/1980 | Pries | 202/256 |
| 4,286,792 | A * | 9/1981 | Hagedorn et al. | 277/409 |
| 5,609,731 | A | 3/1997 | Giertz et al. | |
| 7,094,321 | B2 | 8/2006 | Krebber et al. | |
| 7,097,743 | B2 | 8/2006 | Krebber et al. | |
| 8,491,757 | B2 * | 7/2013 | Lonardi et al. | 202/254 |
| 2010/0200070 | A1 * | 8/2010 | Lonardi et al. | 137/1 |
| 2012/0118721 | A1 * | 5/2012 | Krebber et al. | 202/256 |

FOREIGN PATENT DOCUMENTS

| | | | |
|---|---|---|---|
| DE | 44 24 874 | C1 | 1/1996 |
| EP | 0 649 455 | B1 | 1/1998 |
| EP | 1 390 440 | B1 | 7/2006 |

* cited by examiner

DEVICE FOR COMPENSATING DEVIATIONS FROM A COAXIAL ARRANGEMENT OF COMPONENTS OF A REGULATING ORGAN TO CONTROL THE GAS PRESSURE OF A COKE OVEN CHAMBER

BACKGROUND OF THE INVENTION

The invention relates to a device for compensating deviations from a coaxial arrangement of components of a regulating organ, said regulating arrangement being comprised of a regulating organ, a crown pipe, and an immersion cup which serve for controlling the gas pressure of a coke oven chamber, with the regulating arrangement being comprised of an immersion cup with a water immersion that seals the gas space of a coke oven chamber versus the gas collecting main and/or plant units downstream, and wherein the height of the water level of the water immersion represents a regulating means to control the gas pressure, and wherein said regulating arrangement is furthermore comprised of an immersion pipe that configures a specially shaped crown pipe at its end submerging into the water of the immersion cup, and that is comprised of a regulating organ to regulate the water level. The invention ensures that there occur no deviations in the concentric configuration of the regulating arrangement and that the lock plug of the regulating organ always moves centrically and tightly sealing into the envisaged sealing seat of the lock plug of the immersion cup.

On operation of coke oven chambers, a coking gas is produced which in general streams into the free gas space above the coke cake and which is conducted from there to further processing stages. The coking gas is obtained at a certain pressure which depends on the temporal course of the coal carbonization process. In general, the temporal course of the gas output from a coke oven chamber during the carbonizing cycle takes a well predictable course. As this course is not constant but dependent on the momentary stage of the carbonizing process, pressure fluctuations occur in the coke oven chamber gas space during the carbonizing process.

However, efforts are pursued to keep the gas pressure in the free gas space above the coke oven chamber as constant as possible throughout the entire duration of coal carbonization. Some configurations also permit an increase in gas pressure towards the end of the carbonizing cycle. In particular, however, efforts are pursued to rate the gas pressure in the coke oven chamber always at such a level that no ambient air is sucked into the oven, which can be achieved by ensuring that a slightly positive pressure versus the exterior atmosphere is always maintained by way of a suitable regulation of the gas pressure in the entire coke oven chamber.

For this reason, there are regulating devices by means of which the pressure of a coke oven chamber can be kept constant or be controlled, too, during the entire carbonizing process. An exemplary configuration for this purpose provides for conducting the coking gas to be discharged from a coke oven chamber through a water volume configured as a water immersion so that the gas pressure in the coke oven chamber is regulated by the level of the water immersion and by its pressure. Located above the water immersion is the gas space of a so-called gas collecting main which represents a collecting tank for discharged coking gas and which is constantly filled with a sump amount of water through the water flowing over from the immersion cup. As the pressure in the coke oven chamber and the pressure in the gas collecting main can be separated from each other by way of this design, the suction from the gas collecting main can be improved, thus enabling a better processing of coke oven gas and achieving reductions in emissions on the whole.

An exemplary design and the method applied thereby is disclosed in EP 649455 B1. The gas space of a coke oven chamber is connected to an ascension pipe which terminates into an ascension pipe elbow configured as an immersion pipe, said elbow submerging into a cup-shaped lock seal. This cup-shaped lock seal which is also designated as an immersion cup is filled with water through a coal water line. The coal water line is regulated via a regulating valve which dependent on pressure conditions in the coke oven chamber maintains the water level in the immersion cup at a precisely definable level. As this device can be provided for each individual coke oven chamber, it is thus possible to regulate the gas pressure in each individual coke oven chamber and to control the output of coking gas over the entire coke oven battery or coke oven bank via the time or to keep it constant. At its submerging end, the immersion pipe is provided with a special shape to prevent that an edge running in parallel to the water level leads to an over-swinging of the pressure control and to a pulsation of the immersion seal.

An advanced development of this device is described in US 2004/0084293 A1. Here the immersion pipe terminates in an immersion cup having an outlet similar to a drain outlet. It can be sealed with a plug-like control valve that can be moved by a motion bar leading through the immersion pipe into the drain outlet. In this manner, the drain outlet can be sealed so that the so-called immersion bucket taking charge of the function of the immersion cup constantly has a precisely controllable height of the water level. The coke oven chamber is equipped with pressure measuring devices by way of which the height of the motion bar and thus the water level in the immersion cup are controlled. Since the quantitative output of coke oven gas takes a similar course over the time during a carbonizing cycle, it can be recorded by a process computer so that modifications to the temporal adjustment of the motion bar in the course of the subsequent carbonizing cycles are small.

This system has a disadvantage in that the ascension pipe and the motion bar contained therein including the lock plug of the drain outlet may change in position in the envisaged sealing seat during the operation of the system. For example, this is due to expansion processes or settlement processes in the coke oven chamber caused by fluctuations in temperature during operation. As a result hereof, the lock plug fails to seal tightly so that the water level in the immersion cup is no longer reliably controllable during operation. In particular, for example, the motion bar might be bent or the immersion cup might be dislocated laterally. This leads to a non-controlled change of the water level in the immersion cup and thus to a no longer controllable pressure in the coke oven chamber.

BRIEF SUMMARY OF THE INVENTION

Now, therefore, it is the object to provide a device by means of which a reliably lockable control and regulation for the water level of an immersion cup is feasible. In particular, this means that the immersion pipe with the immersing end is not shifted versus the gas collecting main with the immersion cup.

The invention solves this task by providing for a device comprised of an immersion cup fastened by holders to the top of the gas collecting main and being deflectable so that the immersion cup can be spatially moved, while at the same time place-keeping elements preventing a dislocation of the immersion cup versus the immersion pipe are fastened to the inner side of the immersion cup or to the outer side of the immersion pipe. In this manner, the sealing cup is spatially flexible versus the gas collecting main and thus versus the coke oven chamber in case of expansion or settlement processes, whereas the immersion cup is spatially fixed versus the immersion pipe.

The movable holders can be formed, for example, by wire ropes or chain links, whereas the place-keeping elements are formed by metal sheets or bolts fastened either to the inner sides of the immersion cup or to the outer sides of the immersion pipe. The submerging end of the immersion pipe can be designated as a crown pipe, because it is provided with a shape that prevents pulsation as gas streams into the immersion cup.

Claimed in particular is a device for controlling and regulating the gas pressure of a coke oven chamber, said device comprised of

- an ascension pipe leading vertically upward out of a coke oven chamber and connected to an elbow branching off from the ascension pipe in lateral direction and passing vertically downward over into an immersion pipe which leads into an immersion cup, wherein the elbow must contain at least one water inlet, and
- an immersion cup having a conically tapered bottom and having an outlet for water at its lower bottom end, and which is open towards the top or which has an outlet for coking gas in the upper part, and
- a crown pipe which forms the inlet into the immersion pipe with the water level of the vertically downward leading immersion pipe and which is provided with serrated or gap-shaped moldings in the rims, and
- a regulating organ which controls and regulates the outflow quantity by opening or closing the lower discharge pipe of the aperture at the bottom, and which is connected to a motion bar which leads upward through the inner space of the crown pipe and through the lid of the immersion pipe to a motion mechanism, and which is characterized in that

- the immersion pipe is flexibly suspended with at least three deflectable elements so that these can be moved in horizontal direction, and
- the crown pipe at its outer side or the immersion pipe at its inner side comprise guiding elements in the part located inside the immersion cup, said guiding elements serving to guide the crown pipe in the immersion cup and being located between the crown pipe and the immersion cup, and which owing to their size allow for a precisely determined mobility within the immersion cup.

The device is so configured that the immersion cup is fastened at its upper end with ropes or bars or comparable devices by way of which these are fastened to the top of the gas collecting main or to the immersion pipe. These devices are holding bars which in their extension contain a deflectable or expandable chain piece or wire rope piece. The immersion cup is fastened to at least three of these devices in order to ensure safe retention of the immersion cup in the gas collecting main. Typically these are three devices, but it may also be four or five devices. It is possible to provide any arbitrary number of these holding devices to fasten the immersion cup in the gas collecting main.

This design is intended to prevent that the immersion cup is pulled along whilst actuating the regulating organ, because the lock plug of the regulating organ might get stuck at the sealing seat of the immersion cup due to tar deposits originating from coke oven gas condensates. For this reason, the place-keeping elements in general are only deflectable in horizontal direction. Therefore, it is also feasible to provide hold-down elements that restrict the free mobility of the immersion cup in vertical direction. For example, hold-down elements may be screw unions in the suspension of the immersion cup at the top of the gas collecting main which restrict the mobility of the suspension of the immersion cup.

At their outer rims, the immersion pipe and, more particularly, the crown pipe are equipped with guiding elements. These guiding elements may be bolts projecting from the outer side of the ascension pipe or crown pipe. For example, these elements may be adjustable in their size or length relative to the crown pipe. Thereby, the distance between crown pipe and immersion cup can be maintained at a precisely defined measure.

However, the guiding elements may also be fastened to the inner side of the immersion cup. For example, the inner rim of the immersion cup may be provided with elements that ensure a precisely defined distance between crown pipe and immersion cup during the entire coal carbonization process. These, too, may be adjustable in their size or length relative to the immersion cup.

Finally, it is possible to fasten the guiding elements on both sides, i.e. both on the outer side of the crown pipe and on the inner side of the immersion cup. Consequently, these elements project in pairs both from the inner side of the immersion cup and from the outer side of the crown pipe. Here, too, it is possible that at least one of the bolts is adjustable in its size or spatial extension in relation to the immersion cup or crown pipe.

The guiding elements may be metal sheets, for example. These may have a planar shape. However, the guiding elements may also be bolts or pipe section, for example.

The regulating organ may also be of any arbitrary configuration. Preferably it is a motion bar which a lock plug is fastened to at its lower end. Integrated into the motion bar is a control element for the water flow by means of which the water level in the immersion cup can be controlled and regulated, for example depending on the control signals received from a process computer.

In particular, it is possible to use a regulating organ which for example is described in EP 1390440 B1, wherein an immersion pipe is utilized that is connected to the free gas space of a coke oven chamber and which terminates in the immersion cup, said immersion cup having an overflow as well as a lockable drain, and wherein the immersion pipe is configured with a terminal section, the free gas outlet cross-section of which is dependent on the liquid level in the immersion cup. The liquid level is regulated by a discharge pipe for water, the end of which at one side protrudes into the immersion pipe, and which is comprised of shell-side inflow apertures for the inflow of water, and wherein a slide gate open at both sides is arranged within the discharge pipe, said slide gate locking the inflow apertures of the discharge pipe according to its position in longitudinal direction and forming a vertically adjustable overflow for the water streaming into the discharge pipe, and wherein the end of the discharge pipe on the inflow side is surrounded by a siphon pipe which seals the discharge pipe at the top and forms an annular channel terminating beneath the immersion pipe into the immersion cup to allow for the inflow of water.

The invention bears the advantage in that it ensures a flexible arrangement of the immersion cup in a gas collecting main which is flexible versus expansion and settlement processes, for example due to temperature impacts, and which nevertheless ensures a constant distance between immersion cup and crown pipe.

BRIEF DESCRIPTION OF THE DRAWINGS

The inventive device is elucidated by way of five drawings, with these drawings just representing exemplary embodiments for the design of the inventive device.

FIG. 1 shows a device according to prior art in technology which is suitable for installation of the inventive device and which shows its arrangement in a coke oven chamber.

FIG. 2 shows the inventive device with guiding elements at the inner side of the immersion cup.

FIG. 3 shows the inventive device with guiding elements at the inner side of the outside of the crown pipe.

FIG. 4 shows the inventive device with guiding elements at the inner side of the immersion cup.

FIG. 5 shows the inventive device with guiding elements arranged in pairs at the inner side of the immersion cup and at the outer side of the crown pipe.

DETAILED DESCRIPTION OF THE INVENTION

Figure 1:
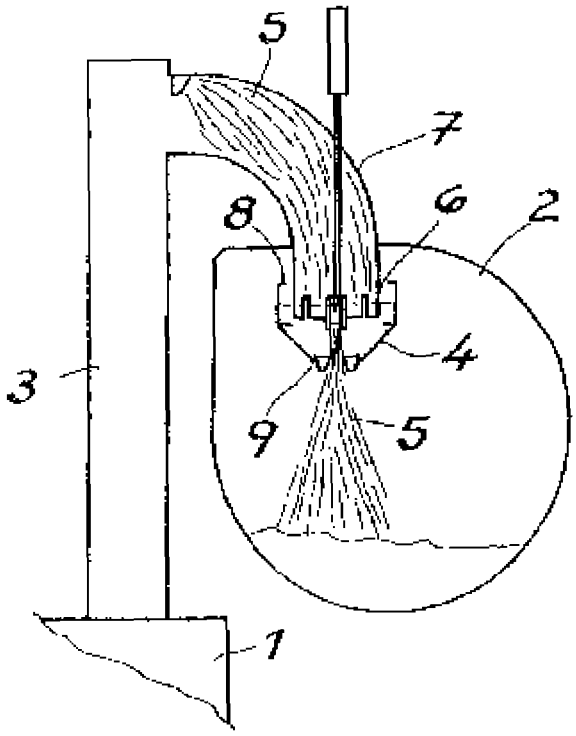
FIG. 1 PRIOR ART
FIG. 1 shows an embodiment of the present invention.

FIG. 1 shows the inventive device according to prior art in technology which is suitable for the use of the inventive device. From the free gas space (1) of the coke oven chamber, the coking gas is conducted into a gas collecting main (2). This purpose is served is by an ascension pipe (3) through which the coking gas is discharged from the coke oven chamber. The control and regulation of the gas pressure in the coke oven chamber is accomplished by the water level in the immersion cup (4) which is filled with water from an inflow (5). The filling-in of coking gas into the water is accomplished via an immersion pipe (6) that configures as a specially shaped crown pipe (7) at its end submerging into the water. Also shown here is the crown pipe (7), the suspension of the immersion cup (8), which may also reach to the top of the gas collecting main, and the lock plug of the regulating organ (9).

Figure 2:
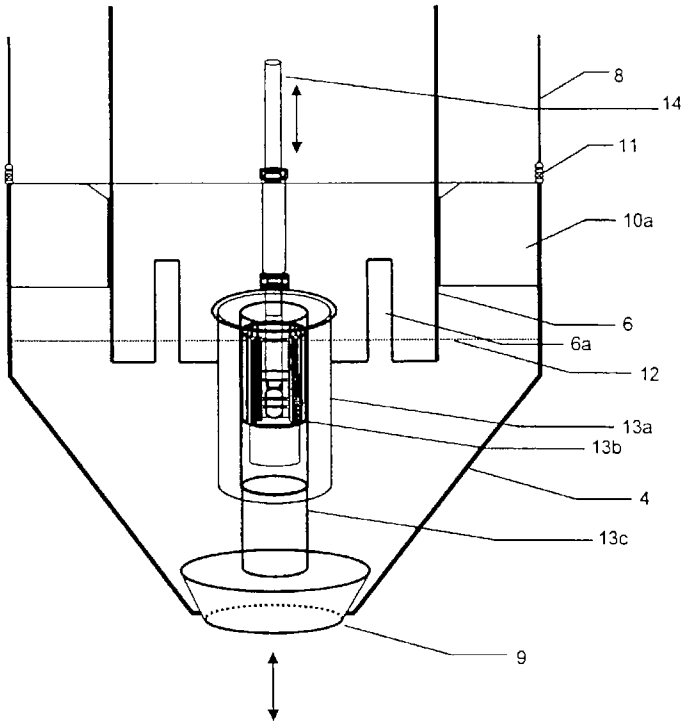
FIG. 2 shows an embodiment of the present invention fastened to the inner side of the immersion cup.

FIG. 2 shows an inventive device which is fastened to the inner side of the immersion cup (4). These are metal sheets, pipe sections or bolts serving as guiding elements (10*a*) which ensure constant distance between the immersion cup (4) and the crown pipe (6). The immersion cup (4) is fastened to the upper top of the gas collecting main (2), with expandable chain links as deflectable elements (11) providing for their mobility, thus making it possible to follow expansion or settlement processes of the coke oven chamber. The crown pipe (6) is provided with serrated moldings (6*a*), via which the coking gas streams through the water level (12) into the gas collecting main. To be seen here, too, is the lock plug (9) of the regulating organ. The regulating organ is comprised of a siphon pipe (13*a*), a vertically adjustable slide gate (13*b*), and a discharge pipe (13*c*), with an inflow of water into the immersion cup (4) taking place via the siphon pipe (13*a*) or wherein a drain is accomplished through the discharge pipe (13*c*) into the gas collecting main (2), which can be controlled and regulated via the position of the vertically adjustable slide gate (13*b*) and the connected motion bar (14). The motion bar is connected to a motion mechanism.

Figure 3:
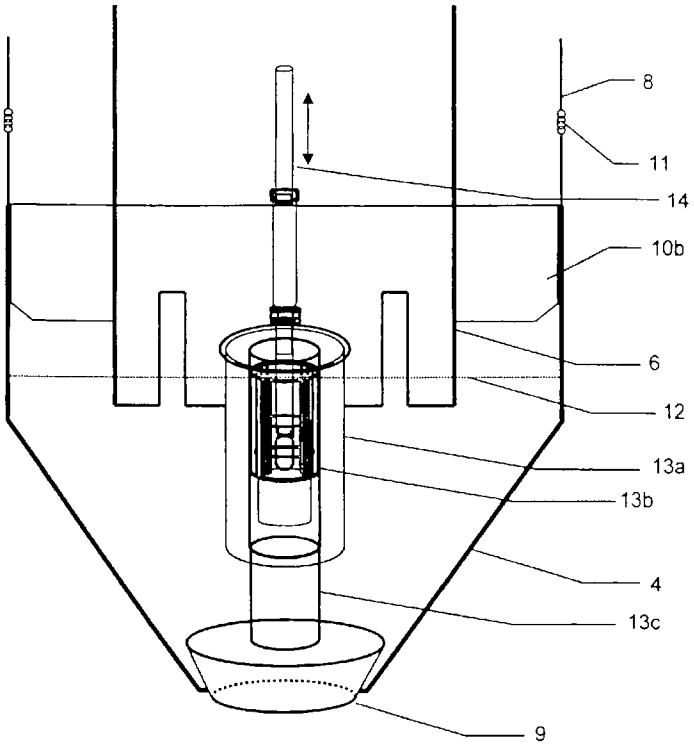
FIG. 3 shows an embodiment of the present invention fastened to the outer side of the crown pipe.

FIG. 3 shows an inventive device which is fastened to the outer side of the crown pipe (6). Likewise, these are metal sheets, pipe sections or bolts serving as guiding elements (10*b*) which ensure constant distance between the immersion cup (4) and the crown pipe (6). The immersion cup (4) is fastened to the upper top of the gas collecting main (2), with expandable chain links as deflectable elements (11) providing for their mobility, thus making it possible to follow expansion or settlement processes of the coke oven chamber.

Figure 4:
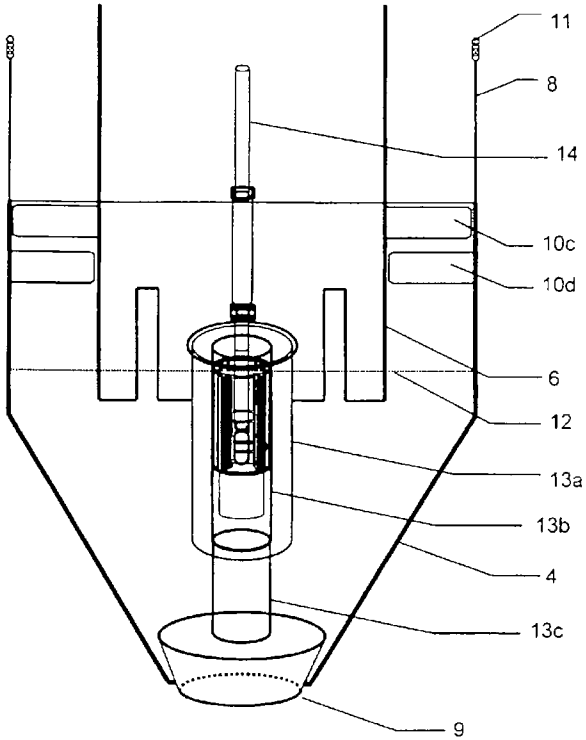
FIG. 4 shows an embodiment of the present invention metal sheets, pipes or bolts serve as the guiding elements.

FIG. 4 shows an inventive device, wherein metal sheets, pipe sections or bolts serving as guiding elements (10*b*, 10*c*) of a guiding element couple are fastened both to the outside of the crown pipe (6) and to the inside of the immersion cup. Likewise, these are guiding elements (10*b*) which for example are made of metal sheet, as a pipe section or as a bolt and which ensure constant distance between the immersion cup (4) and the crown pipe (6). The immersion cup (4) is fastened to the upper top of the gas collecting main (2), with expandable chain links as deflectable elements (11) providing for their mobility, thus making it possible to follow expansion or settlement processes of the coke oven chamber.

Figure 5:
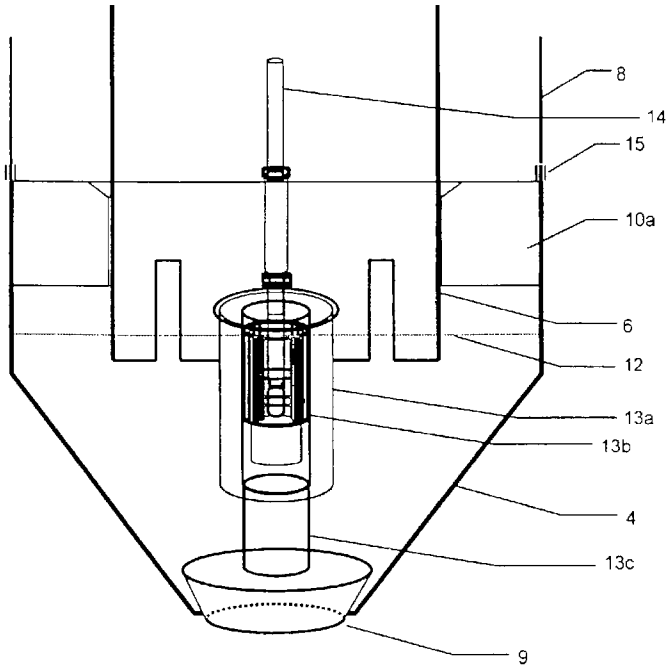
FIG. 5 shows an embodiment of the present invention fastened to the outer side of the crown pipe.

FIG. 5 shows an inventive device which is fastened to the outer side of the crown pipe (6). These are guiding elements (10*a*) which for example are made of metal sheet, as a pipe section or as a bolt and which ensure constant distance between the immersion cup (4) and the crown pipe (6). The immersion cup (4) is fastened to the upper top of the gas collecting main (2), with expandable wire rope links (15) providing for their mobility, thus making it possible to follow expansion or settlement processes of the coke oven chamber.

LIST OF REFERENCE SYMBOLS

1 Free gas space of the coke oven chamber
2 Gas collecting main
3 Ascension pipe
4 Immersion cup
5 Drained water
6 Crown pipe
6*a* Serrated moldings of the crown pipe
7 Immersion pipe
8 Suspension of the immersion cup
9 Lock plug of the regulating organ
10*a* Metal sheet, pipe section or bolt serving as guiding element at the inner side of the immersion cup
10*b* Metal sheet, pipe section or bolt serving as guiding element at the outer side of the crown pipe
10*c* Metal sheet, pipe section or bolt at the outer side of the crown pipe serving as guiding element of a guiding element couple
10*d* Metal sheet, pipe section or bolt at the inner side of the immersion cup serving as guiding element of a guiding element couple
11 Chain links as deflectable elements
12 Water level
13*a* Siphon pipe
13*b* Vertically adjustable slide gate
13*c* Discharge pipe
14 Motion bar of the regulating organ
15 Wire rope links

The invention claimed is:

1. A device for controlling and regulating the gas pressure of a coke oven chamber comprising:

an ascension pipe leading vertically upward out of a coke oven chamber and comprising an elbow branching off from the ascension pipe in a lateral direction and passing vertically downward over into an immersion pipe that is configured as a specially shaped crown pipe at its end which submerges into water of an immersion cup, wherein the elbow comprises at least one water inlet; wherein the immersion cup has a conically tapered bottom and an outlet for water at its lower bottom end; and is open towards the top; or has an outlet for coking gas in the upper part; and the immersion cup is fastened by holders to the top of a gas collecting main and is deflectable so that the immersion cup can be spatially moved; the device further comprising a crown pipe which forms the inlet into the water basin of the vertically downward leading immersion pipe and which is provided with serrated or gap-shaped moldings in the rims; and a regulating organ which controls and regulates an outflow quantity of water for a precisely controllable height of the water level by opening or closing a siphon pipe of a lock plug of the regulating organ, and which is connected to a motion bar which leads upward through the inner space of the crown pipe and through a lid of the immersion pipe to a motion mechanism; wherein the immersion cup is flexibly suspended with at least three deflectable elements so that these can be moved in horizontal direction, and the crown pipe at its outer side or the immersion cup at its inner side comprise guiding elements in the part located inside the immersion cup, the guiding elements serving to guide the crown pipe in the immersion cup and being located between the crown pipe and the immersion cup and which projecting from the outer side of the crown pipe or from the inner side of the immersion cup for a precisely determined mobility within the immersion cup.

2. The device for controlling and regulating the gas pressure of a coke oven chamber according to claim 1, wherein the deflectable elements in their further extension comprise a chain link.

3. The device for controlling and regulating the gas pressure of a coke oven chamber according to claim 1, wherein the deflectable elements in their further extension comprise a wire rope piece.

4. The device for controlling and regulating the gas pressure of a coke oven chamber according to claim 1, wherein the guiding elements project from the outer side of the crown pipe.

5. The device for controlling and regulating the gas pressure of a coke oven chamber according to claim 4, wherein at least one of the guiding elements projecting from the outer side of the crown pipe is adjustable in its size or length in relation to the crown pipe.

6. The device for controlling and regulating the gas pressure of a coke oven chamber according to claim 1, wherein the guiding elements project from the inner side of the immersion cup.

7. The device for controlling and regulating the gas pressure of a coke oven chamber according to claim 6, wherein the guiding elements are adjustable in their size or length in relation to the immersion cup.

8. The device for controlling and regulating the gas pressure of a coke oven chamber according to claim 1, wherein the guiding elements project in pairs both from the inner side of the immersion cup and from the outer side of the crown pipe.

9. The device for controlling and regulating the gas pressure of a coke oven chamber according to claim 8, wherein at least one of the guiding elements is adjustable in its size or spatial extension in relation to the immersion cup or crown pipe.

10. The device for controlling and regulating the gas pressure of a coke oven chamber according claim 1, wherein the guiding elements are planar metal sheets.

11. The device for controlling and regulating the gas pressure of a coke oven chamber according to claim 1, wherein the guiding elements are bolts.

12. The device for controlling and regulating the gas pressure of a coke oven chamber according to claim 1, wherein the guiding elements are pipe sections.

13. The device for controlling and regulating the gas pressure of a coke oven chamber according to claim 1, wherein the deflectable elements are only deflectable in a horizontal direction.

14. The device for controlling and regulating the gas pressure of a coke oven chamber according to claim 1, further comprising holding-down elements that restrict the vertical mobility of the immersion cup.

* * * * *